United States Patent [19]

Gates

[11] 4,098,305

[45] Jul. 4, 1978

[54] CONTINUING LIQUID SAMPLING APPARATUS AND METHOD

[75] Inventor: Wendall C. Gates, Santa Cruz, Calif.

[73] Assignee: Manning Environmental Corporation, Santa Cruz, Calif.

[21] Appl. No.: 667,990

[22] Filed: Mar. 18, 1976

[51] Int. Cl.[2] ..... B65B 3/04; B65B 55/10; B67C 1/00

[52] U.S. Cl. ..... 141/92; 134/72; 134/131; 141/130

[58] Field of Search ..... 53/109, 381 A; 73/421 R, 421 B; 23/253 R, 259 R; 134/21, 22 R, 72, 131; 141/1, 5, 7, 59, 82, 85, 89–92, 98, 118, 124, 126, 130, 171, 181, 270, 279, 374, 379, 164, 168, 286

[56] References Cited

U.S. PATENT DOCUMENTS

| | | | |
|---|---|---|---|
| 3,192,968 | 7/1965 | Baruch et al. | 141/90 X |
| 3,684,452 | 8/1972 | Bessman | 141/130 X |
| 3,706,413 | 12/1972 | Blum | 141/90 X |
| 3,932,979 | 1/1976 | Stock et al. | 53/381 A |
| 3,945,411 | 3/1976 | Skoli et al. | 141/91 |

*Primary Examiner*—Richard E. Aegerter
*Assistant Examiner*—Frederick R. Schmidt

[57] ABSTRACT

A continuous sampler having a predetermined number of sample containers in which a sample from a liquid flow is deposited at predetermined intervals of time. Samples are deposited in sample containers in a sampling position and the sample containers are stepped once each interval of time through a path of travel until they assume a cleaning position adjacent to the sampling position. A sample removal probe and a wash probe is lowered through an access opening in the sample container in the cleaning position and a source of washing solution is coupled to the wash probe and means for removing the contents of the sample container is coupled to the sample removal probe. Means for controlling the position of the wash and sample removal probes in a position inside the sample container in the cleaning position and in a position remote therefrom, as well as controlling the means for removing samples therefrom and the means coupling a wash solution thereto is provided. The wash probe is purged by introduction of pressurized air prior to removing the wash probe from the interior of the sample container in the cleaning position and the means for removing the contents of the sample container in the sample cleaning position continues to function until the sample container is advanced from the cleaning position to the sampling position. Residual wash solution and removed liquid in the wash probe and sample removal probes respectively is thereby precluded from collecting in the sample container in the cleaning position.

1 Claim, 5 Drawing Figures

CONTINUING LIQUID SAMPLING APPARATUS AND METHOD

BACKGROUND OF THE INVENTION

This invention relates to a sample collection and storage device and more particularly to such a device for accepting continuous samples from a liquid sampler for discrete storage without pollution of the samples while retaining only a predetermined number of the most recent samples taken.

In the policing of pollution laws and in long term analysis of the pollution history of rivers, sewers, and other flow systems, a requirement exists to have samples available which were taken immediately preceding a time at which the need for the samples was determined. Clearly, indefinite sampling and storage of samples is impractical. One solution is to continuously sample and continuously empty the oldest samples manually from the sample containers. Such a scheme is unwieldy and expensive considering the continuous labor effort necessarily expended in monitoring the sample storage and emptying the oldest samples from the sample containers. Therefore, a sample receiving and storage device is needed which regularly receives new samples and regularly eliminates the oldest sample taken, while cleaning the sample containers so that they may be reused without danger of contaminating samples subsequently deposited therein.

Known prior art samplers contain a number of discrete sample holding containers which are filled in sequence as a function of time or any other desired parameter, and which are deenergized when samples have been introduced to all of the available sample containers. Such samplers cannot be used for the aforementioned purpose.

SUMMARY AND OBJECTS OF THE INVENTION

The disclosed continuing sampling apparatus receives and stores a predetermined number of liquid samples taken over an immediately preceding predetermined period of time. The apparatus includes a plurality of sample containers each having access openings and a support for the plurality of sample containers so that they are arranged in a predetermined array. A wash probe and a sample removal probe are provided for relative displacement with the access openings in the array of sample containers. The wash and sample removal probes are configured to pass through the access openings. Mechanical structure is provided for guiding the wash and sample removal probes between a wash and sample removal position inside one of the sample containers at a cleaning position in the array, and a standby position remote therefrom, and also for driving the probes therebetween. Efflux means is coupled to the sample removal probes for urging liquid removal from a sample container in the cleaning position. Influx means is coupled to the wash probe for directing a wash solution into the sample container in the cleaning position. Drive means impart the relative displacement between the wash and sample removal probes and the sample container in the cleaning position. Control means provide control during a sample container wash period for causing the wash and sample removal probes to assume a position inside the sample container in the cleaning position, to cause the efflux means to remove liquid from the sample container, to cause wash solution to be injected into the sample container for cleansing and to be subsequently removed through the sample removal probe, to cause the wash and sample removal probes to assume the remote position, and to advance the clean sample container from the cleaning position to the sampling position for receiving a most recent sample from the liquid flow.

The method includes moving a plurality of sample containers to dwell at adjacent sampling and cleaning position for a predetermined dwell time. Thereafter, lowering of a wash and exhaust probe into the sample container in the cleaning position is accomplished. Further method steps include removing liquid from the container in the cleaning position through the exhaust probe and injecting a wash solution therein through the wash probe for subsequent removal also through the exhaust probe. A clean sample container is provided in the cleaning position followed by raising of the wash and exhaust probes from the clean sample container. The lowering of the probes, removing of the liquid, injecting of the wash solution and raising of the probes takes place within the predetermined dwell time. Thereafter, the method includes advancing the clean sample chamber to the sampling position and depositing a liquid sample therein, whereby the predetermined total period of time during which the samples are taken is determined by the number of liquid samples in the predetermined dwell time.

In general, it is an object of the present invention to provide a continuing sampler for provision of liquid samples all of which have been taken at known times prior to a desired sample analysis time.

Another object of the invention is to provide a continuous sampler which minimized pollution of subsequent samples deposited in sample containers previously containing other samples.

Another object of the present invention is to provide a continuous sampler which leaves minimal residue in the sample containers subsequent to removal of old samples therefrom and washing of the container.

Another object of the present invention is to provide a continuous sampler for indefinitely extracting samples from a fluid flow and storing the most recent group of the indefinite number of samples.

Another object of the present invention is to provide a continuous sampler for use in conjunction with available or subsequently developed sample extracting apparatus.

Additional objects and features of the invention will appear from the following description in which the preferred embodiments are set forth in detail in conjunction with the accompanying drawings.

DESCRIPTION OF THE PREFERRED EMBODIMENTS

Figure 1:
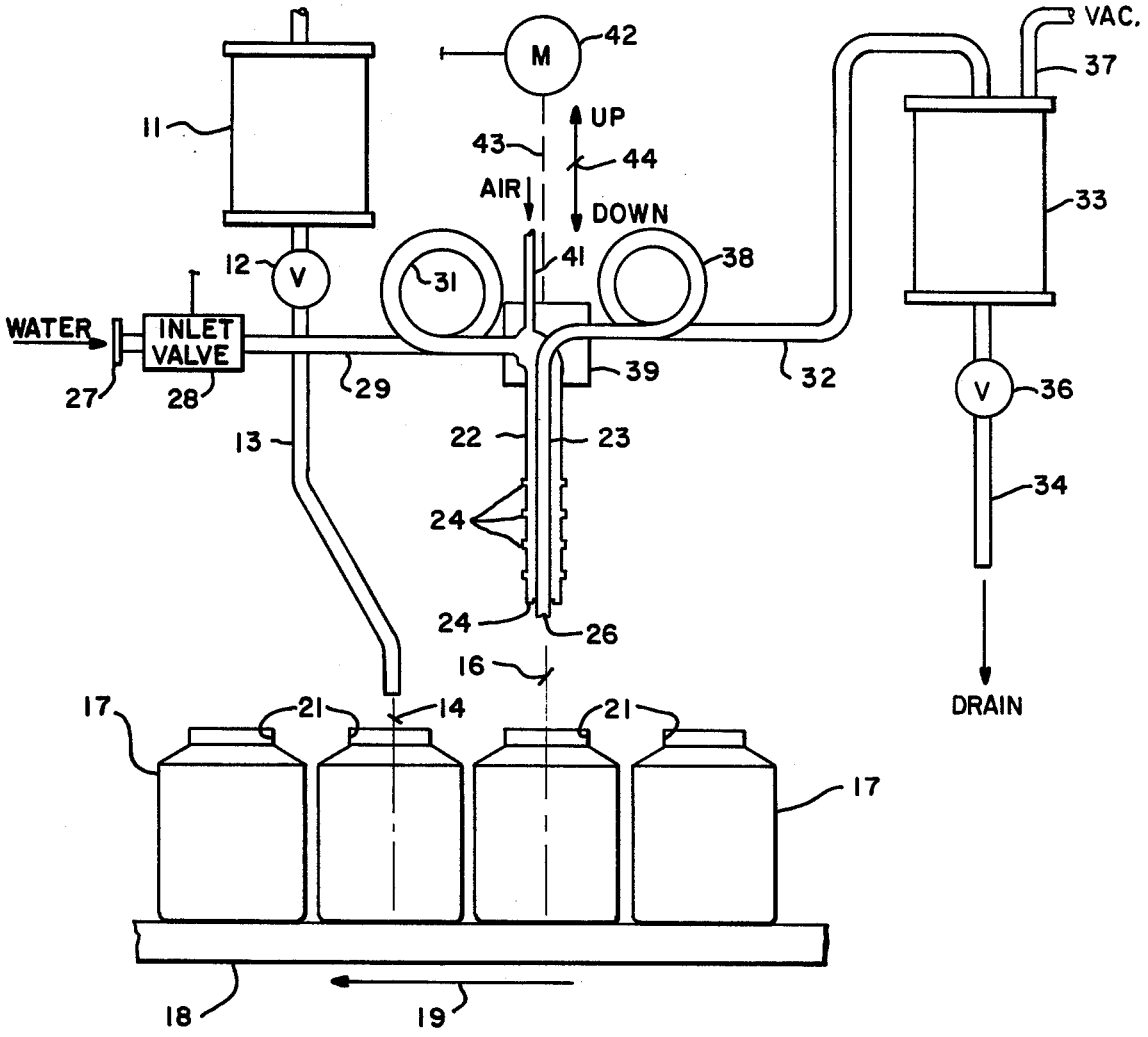
FIG. 1 is a mechanical schematic of one embodiment of the present invention.

Referring to FIG. 1, a sample chamber 11 is shown for collecting measured liquid samples at predetermined intervals and having a valve 12 in an outlet line 13 leading therefrom as disclosed in U.S. Pat. No. 4,022,059 for a Flow and Time Proportional Sampling System. Outlet line 13 leads to a sampling position 14 adjacent to a cleaning position 16. A plurality of sample containers 17 is supported on support structure 18. Relative motion between sample containers 17 and sampling and cleaning positions 14 and 15 respectively is obtained either through motion imparted to supporting structure 18 as shown by arrow 19 or in the alternative by moving positions 14 and 16.

Sample containers 17 have access openings 21 therein for receiving samples therethrough from sample outlet line 13. A wash probe 22 and a sample removal probe 23 both coincide with cleaning position 16. Wash probe 22 has a plurality of spray apertures 24 and cleaning probe 23 has an intake aperture 26 at the bottom thereof. Means is provided coupled to wash probe 22 for introducing a wash solution thereto, such as coupling 27, inlet valve 28 and wash solution inlet line 29. Coupling 27 is adapted to connect to a source of washing solutions such as water, and wash solution inlet line 29 is shown with a slack loop 31 therein. Means is provided coupled to cleaning probe 23 for removing liquid from sample containers 17 at cleaning position 16 including, in this embodiment, a sample removal line 32, a sample and wash liquid receiving chamber 33 and a drain line 34. A valve 36 is disposed in drain line 34 for draining sample and wash liquid receiving chamber 33. A low pressure line 37 is attached to the upper portion of sample and washing liquid receiving chamber 33 for introducing a vacuum thereto and subsequently to cleaning probe 23. Sample removal line 32 has a slack loop 38 located therein.

A manifold block 39 is provided for holding wash and cleaning probes 22 and 23, as well as the connections of wash solution inlet line 29 and sample removal line 32 thereto respectively. A high pressure air inlet line 41 is shown entering manifold block 39 for communication with wash probe 22. Means for lowering or raising manifold block 39 is shown as motor 42, having mechanical linkage 43 to manifold block 39. Motor 42 through linkage 43 provides for up and down motion as indicated by arrow 44. Such motion is afforded by slack loops 31 and 39, but it should be understood that the motion of manifold block 39 is relative to the sample container 17 in cleaning position 16, and could as easily be effected by motion of support structure 18 in the direction of arrow 44 in FIG. 1.

The operation of the embodiment of FIG. 1 will now be undertaken. Support structure 18 advances sample containers 17 to place one of the number of sample containers 17 at cleaning position 16. Access openings 21 are configured to allow wash and cleaning probes 22 and 23 to pass therethrough, and sample container 17, presumed to have a sample contained therein, contains the oldest sample in all of the samples contained in the array of sample container 17. Motor 42 actuates linkage 43 to lower wash and cleaning probes 22 and 23 through access opening 21 into the interior of sample container 17 in cleaning position 16. Valve 36 is closed and low pressure or vacuum is applied to sample and wash liquid receiving chamber 33, and subsequently to cleaning probe 23. Liquid in sample container 17 is drawn through inlet aperture 26, sample removal line 32 for deposition in sample and wash liquid receiving chamber 33. Inlet valve 28 is opened and washing solution, such as water is delivered through washing solution inlet line 29 to wash probe 22 to be emitted under force through spray apertures 24, thereby impinging upon the inner walls of sample container 17 in cleaning position 16. Washing solution is removed from sample container 17 through aperture 26 in the same fashion as the liquid sample originally residing therein. Inlet valve 28 is actuated to a closed position and air is introduced through air inlet line 41 to purge wash probe 22 of all residual washing solution, which is removed from sample container 17 through aperture 16 as described above. Low pressure is maintained in low pressure line 37 while motor 42 moves manifold block 39 upwardly. Support structure 18 is urged to move sample containers 17 in a direction of arrow 19 so that the cleaned sample container 17 is positioned in sampling position 14. Support structure 18 is retained in this position while valve 12 is opened and the measured sample in sample chamber 11 is placed in the clean sample container 17 at sampling position 14. Subsequently, the low pressure is removed from low pressure line 37 and valve 36 is opened to allow the wash solution and old liquid sample in chamber 33 to drain therefrom, to be disposed of as waste.

Figure 2:
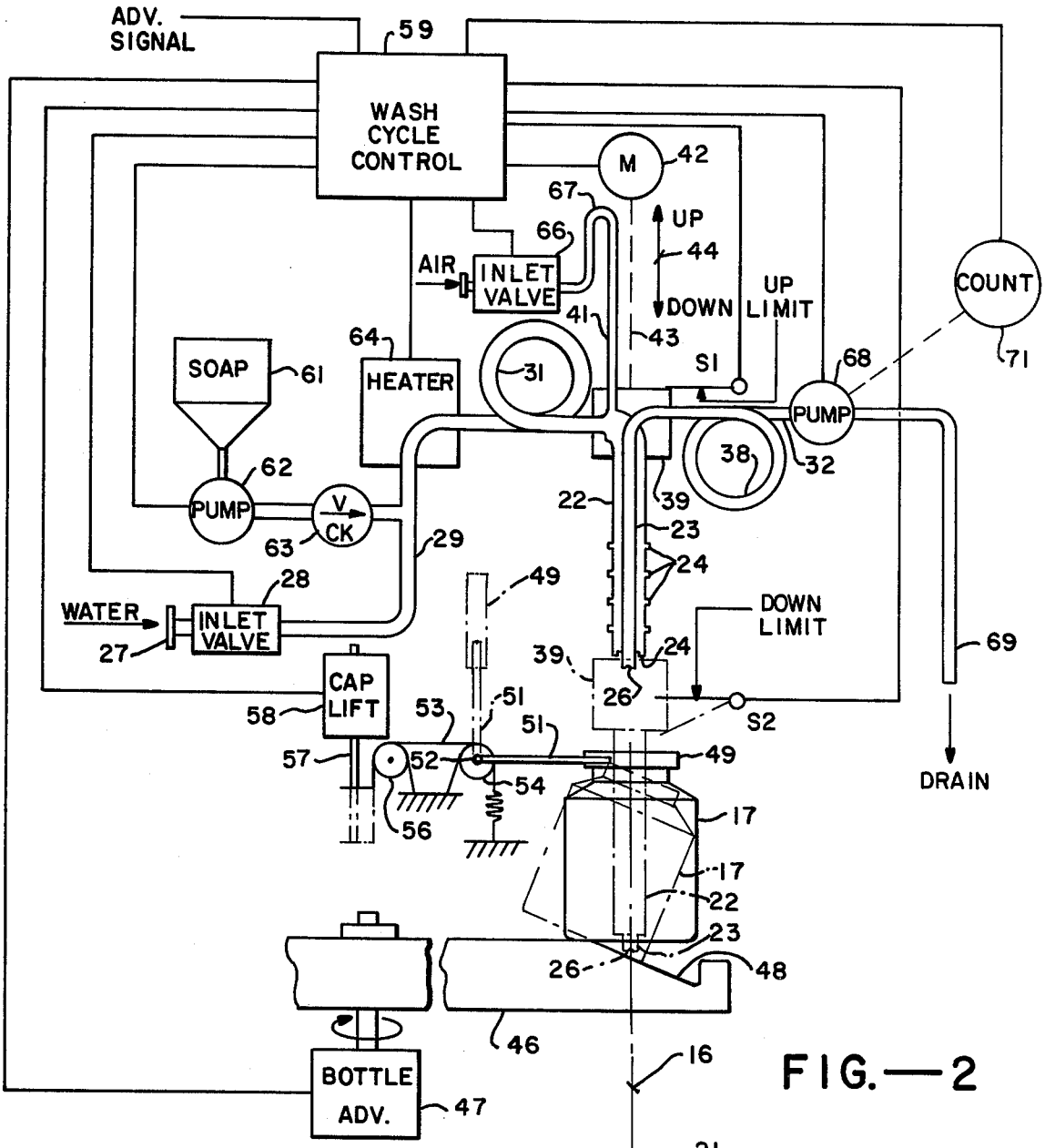
FIG. 2 is a mechanical schematic of a modification of the embodiment of FIG. 1.

Turning now to FIG. 2, an embodiment is shown which has some similarities with the embodiment of FIG. 1 and wherein like components have like item numbers applied thereto. A support structure 46 is shown in the form of a rotating table in this embodiment, being driven by a bottle advance drive 47 in a rotary direction. Sample containers 17 are carried near the periphery of support structure 46, there being a ramp 48 or the like beneath sample containers 17 for allowing cleaning probe 23 to cause sample containers 17 to tilt when lowered into a wash and sample removing position as shown by dotted line in FIG. 2. The tilting of sample containers 17 facilitates removal of liquid sample and washing solution therefrom in the cleaning position. FIG. 2 also shows a cap 49 placed over the access opening 21 in sample containers 17 for retaining bottle sample characteristics. When ones of the plurality of sample containers 17 reach cleaning position 16, a cap remover is actuated which includes cap engagement arm 51 attached to shaft 52. A cap removal cable 53 is shown leading over a pulley 54 attached to shaft 52 and over a pulley 56 attached to the plunger 57 on a cap lift solenoid 58. Cap lift solenoid 58 is controlled by a wash cycle control 59, so that when actuated, cap 49 is lifted into the position approximately as shown in dotted line in FIG. 2.

Motor 42 operates to position manifold block 39 through linkage 43 between an up or remote position and a down or wash and sample removal position. Switch S1 is shown for providing an up limit indication for manifold block 39 and switch S2 as shown for providing a down limit indication for manifold block 39. Influx means are provided as described above, including a coupler 27 for joining to a source of wash solution such as water under pressure, an inlet valve 28 shown connected for control to wash cycle control 59, and wash solution inlet line 29 coupled to wash probe 22. Also coupled to wash solution inlet line 29 is a solvent dispenser such as soap dispenser 61, the contents of which are urged by pump 62 through a check valve 63 to enter and mix with wash solution in line 29. Pump 62 is shown controlled by connection to wash cycle control 59 for selectively dispensing the contents of solvent dispenser 61, such as soap, into wash solution inlet line 29. Wash solution inlet line 29 also has a heater 64 associated therewith for raising the temperature of wash solution traveling therethrough. The introduction of soap and the elevation of the temperature of the wash solution is intended to facilitate cleaning of residue from the inner surfaces of sample container 17 in cleaning position 16. Heater 64 is also controlled by connection to wash cycle control 59.

An air inlet valve 66 is shown disposed in the air inlet line 41. Air inlet valve 66 is also controlled by connection to wash cycle control 59 for selectively introducing high pressure air into wash probe 22 when air inlet line 41 is coupled to a source of high pressure air. Air inlet line 41 is shown having a slack loop 67 therein, serving the same purpose as slack loops 31 and 38 in lines 29 and 32 respectively.

A variation over the embodiment of FIG. 1 is shown in FIG. 2 in the means coupled to cleaning probe 23. As an alternative to the low pressure or vacuum source introduced through line 37 into chamber 33 of FIG. 1, a pump 68 is disposed in sample removal line 32 for pumping liquid sample and wash solution from sample container 17 in cleaning position 16 for disposal through drain line 69. Pump 68 is monitored by count device 71 connected to wash cycle control 59 for the purpose of timing the operation of pump 68.

Figure 2A:
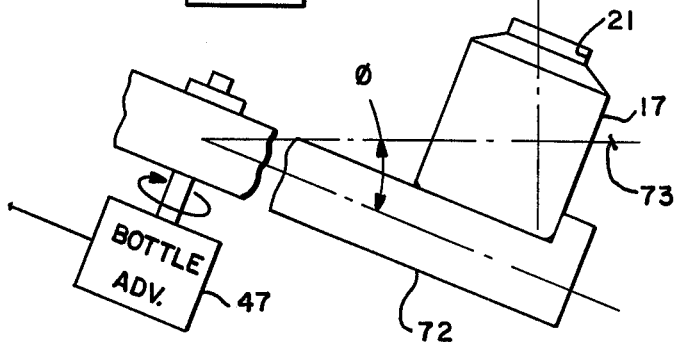
FIG. 2*a* shows a further modification of the embodiment of FIG. 2.

The embodiment of FIG. 2*a* shows an alternative configuration for providing the tilt of sample container 17 at cleaning position 16, which is desirable for facilitating removal of all liquid sample and washing solution contained therein. A tilted supporting structure 72 is shown for holding sample containers 17 near the periphery thereof. It may be seen that the plane of motion of support structure 72 departs from a horizontal plane 73 in FIG. 2*a* by an angle $\phi$. In this fashion, when wash and cleaning probes 22 and 23 are disposed in the washing and sample removal position as shown in dotted line in FIG. 2, the above-referenced facilitation of liquid removal is accomplished.

The embodiment of FIG. 2 functions in the following manner. One of the plurality of sample containers 17 is stepped into cleaning position 16 and is allowed to dwell in that position for a predetermined interval of time. Cap engaging arm 51 engages cap 49 and lifts cap 49 out of the way as described in conjunction with the cap lifting mechanism discussed above. Motor 42 is energized and manifold block 39 is lowered allowing switch S1 to close until block 39 reaches and opens switch S2 as shown. Motor 42 will be stopped by the opening of switch S2 whereupon wash and cleaning probes 22 and 23 are in the washing and sample removal position, as shown in dotted line in FIG. 2. Pump 68 is energized by wash cycle control 59 and liquid sample is removed through aperture 26 to be disposed through drain line 69. Inlet valve 28 is opened, allowing water under pressure to transit wash solution line 29, whereupon it is heated by heater 64 and introduced into wash probe 22 for dispersal through spray apertures 24 to impinge upon the inner surfaces of the sample container 17 in cleaning position 16. Actuation of heater 64 and inlet valve 28 is controlled by wash cycle control 59. Pump 62 is also controlled by wash cycle control 59 to introduce soap from solvent dispenser 61 through check valve 63 into the flow of wash solution through line 69 for dispensing within sample container 17 in cleaning position 16. Residue from the liquid sample on the inner walls of sample container 16 is thereby dissolved and removed in solution through aperture 16. Following a predetermined washing period, air inlet valve 66 is opened and high pressure air is introduced into wash probe 22 for purging residual wash solution therefrom for subsequent removal through aperture 26. Motor 42 is reversed to urge manifold block 39 in an upward position through linkage 43 thereby allowing down limit switch S2 to close and continuing upward until contacting up limit switch S1 to open S1 and stop motor 42 with manifold block 39 in a remote position. Pump 68 is allowed to continue to run while wash cycle control 59 receives an advance signal transmitted to bottle advance 47 for advancing the cleaned sample container 17 from cleaning position 16 to sampling position 14. Thereafter, pump 68 is deenergized so that residual wash solution and liquid sample in cleaning probe 23 will be precluded from draining back into the clean sample container 17. A newly obtained measured liquid sample is now dispensed to the clean sample container 17 in sampling position 14 as described above.

The method of continuous sampling includes the process steps of moving the plurality of sample containers 17 so that they are positioned at adjacent cleaning and sampling positions for a predetermined dwell time. Thereafter, cap 49, if present, is removed to present access opening 21 for reception of wash and cleaning probes 22 and 23. Lowering of manifold block 39 and wash and cleaning probes 22 and 23 is accomplished by actuation of motor 42 to urge manifold block 39 in a downward position until down limit switch S2 is opened and wash and cleaning probes 22 and 23 are positioned in the wash and sample removal position, tilting sample container 17 to facilitate removal of wash solution and liquid sample therefrom through aperture 26. Liquid sample is removed from sample chamber 17 and introduction of washing solution into sample chamber 17 through spray apertures 24 is accomplished, together with heating thereof and introduction of soap thereto as desired for facilitation of dissolving of liquid sample residue on the internal walls of sample container 17. Purging of wash probe 22 is accomplished by actuation of air inlet valve 66 as controlled by wash cycle control 59 and motor 42 is thereafter actuated to urge manifold block 39 in an upward position through linkage 43 after a predetermined wash time has been expended in the down position. Manifold block 39 actuates switch S1 to the open position to indicate wash and cleaning probes 22 and 23 are in the remote position and the array of sample containers 17 is advanced one position to place the cleaned sample container 17 in the sample receiving position. Introduction of a newly obtained sample into the clean sample container 17 is accomplished as described above and the cycle is completed just prior to the reception for storage of the subsequent sample from sample chamber 11.

Figure 3:
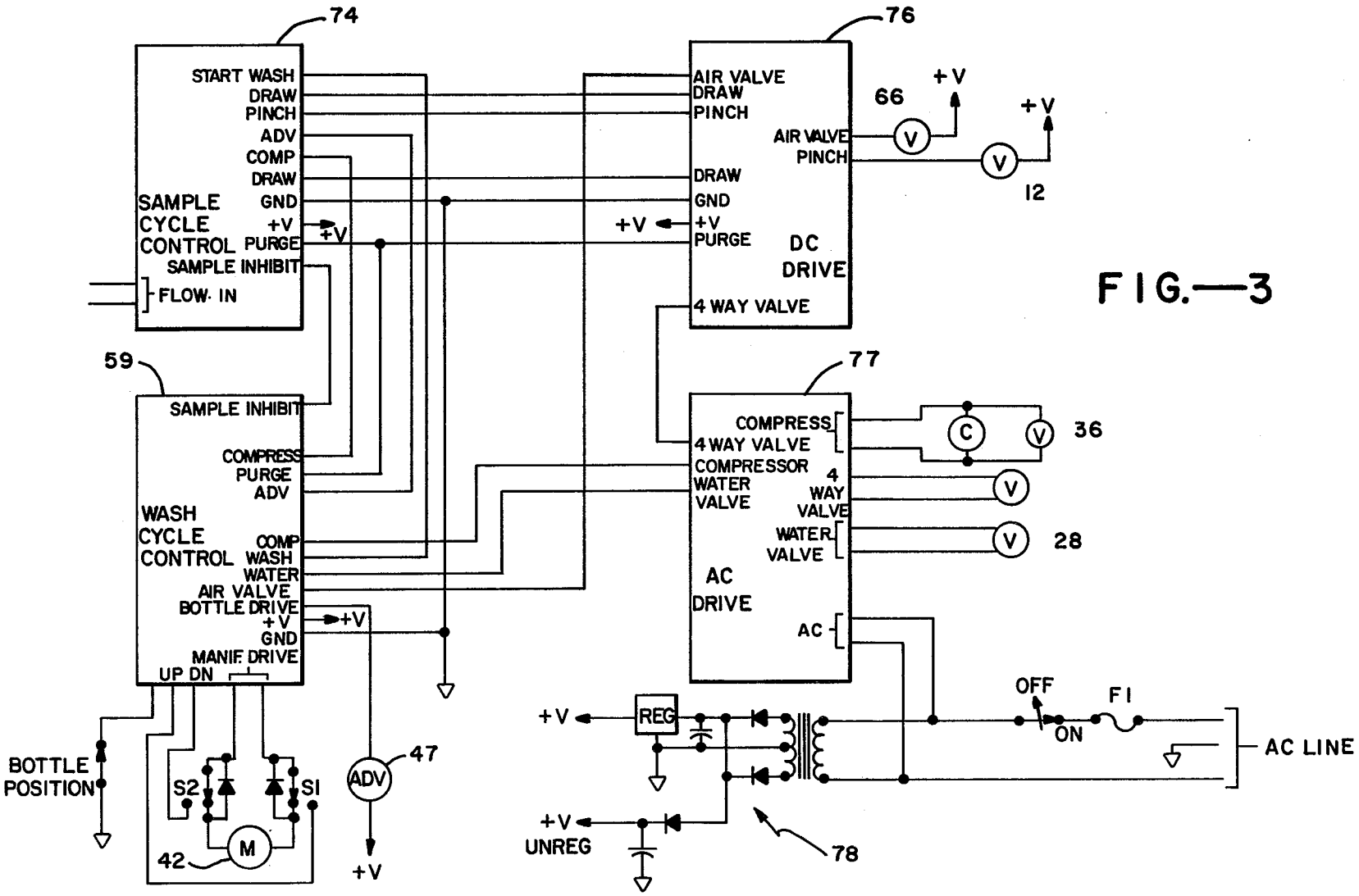
FIG. 3 is an interconnect diagram for the continuous sampler.

Turning to FIG. 3, an interconnect diagram is shown for the purpose of displaying a typical system within which the present invention may function. A sample cycle control 74, a DC drive buss 76, and an AC drive buss 77 are shown together with a DC power supply shown generally at 78, all of which are described in detail in U.S. Pat. No. 4,022,059 referred to above. Item numbers in FIG. 3 which are indicative of like items in FIGS. 1 and 2 are the same as the corresponding item numbers in the latter figures. Wash cycle control 59 is shown interconnected with the other sections of a total sampler for demonstrating the utility of the disclosed invention in conjunction with such a sampler where provision of the most recent series of fluid samples is desired while avoiding constant surveillance of the sampling system.

Figure 4:
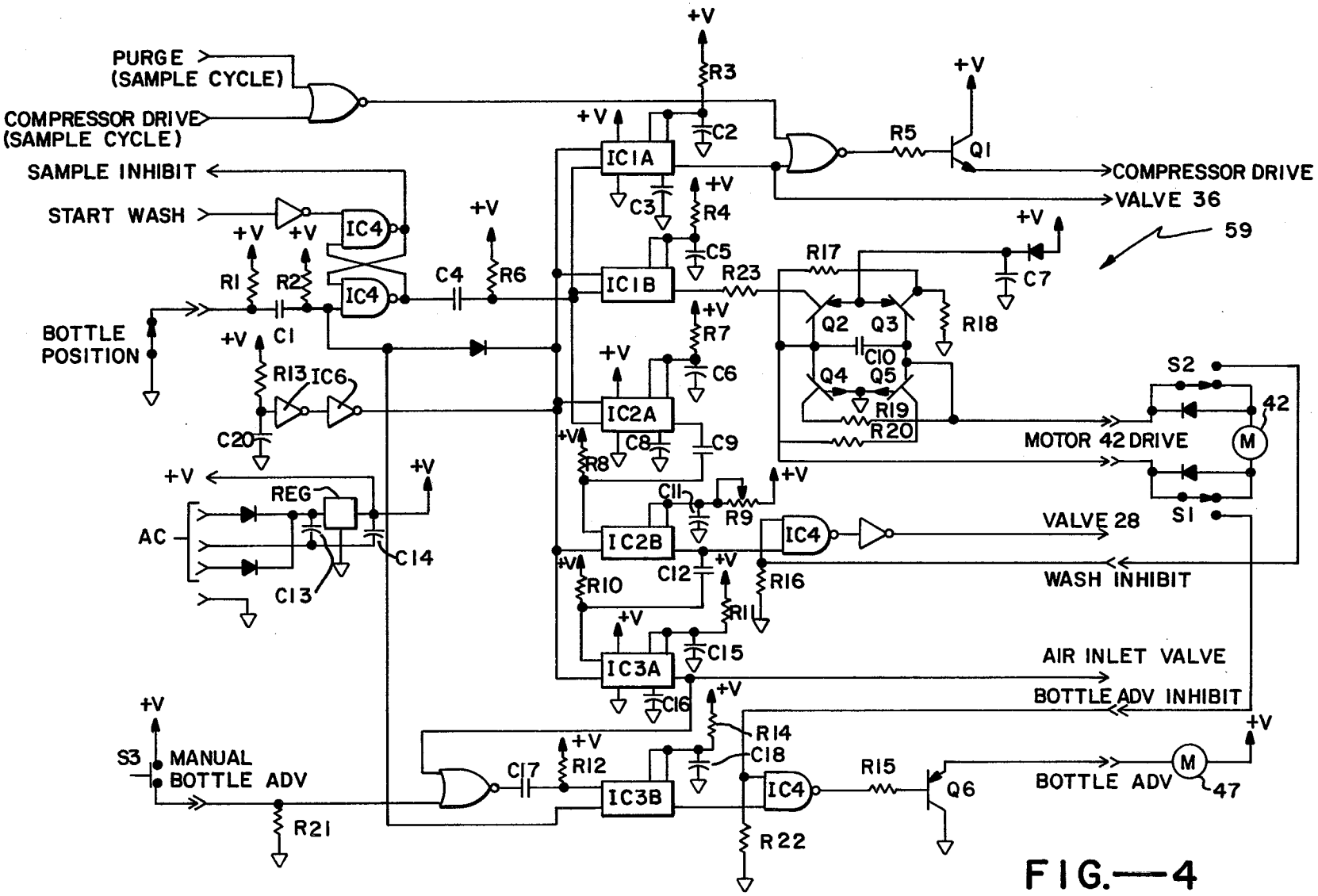
FIG. 4 is an electrical schematic of the wash cycle controller.

Referring now to FIG. 4, wash cycle control 59 circuitry is shown in detail. The wash cycle is initiated by a pulse from the sample cycle control 74 indicating the end of a sample cycle has occured through the "start" line as shown in FIG. 3, such signal being introduced to wash cycle control circuitry 59 as indicated in FIG. 4. This pulse sets latch IC4, which in turn starts the wash control timers IC1-A, IC1-B and IC2-A. A sample inhibit signal is also provided by the latch circuit IC4, to prevent a sample from being taken by sample cycle control 74 during the wash cycle controlled by wash cycle control 59. IC1-A controls the main compressor connected to low pressure line 37 and drain valve 36 in FIG. 1. The compressor will maintain low pressure or vacuum in low pressure line 37 and valve 36 will remain closed, creating a vacuum in sample and wash liquid receiving chamber 33 for about 45 seconds, or until a reset pulse is received indicating that sample containers 17 have advanced to the next position. Advancing sample containers 17 prior to turning off the means for removing liquid sample and wash solution from sample containers 17 precludes draining of residual liquid in cleaning probe 23 back into the cleaned sample container 17 until after the cleaned sample container has advanced from the cleaning position 16.

IC1-B is a timer set for approximately 30 seconds for controlling motor 42 for positioning manifold block 39 through linkage 43. When IC1-B is not triggered, its output is low, turning on transistors Q2 and Q5 and turning off transistors Q3 and Q4. This applies a positive voltage to one side of the motor 42, which will cause the manifold block 39 to be driven upward until up limit switch S1 is opened and the power is interrupted to motor 42. The conditions now present at up limit switch S1 and down limit switch S2 provide wash solution inhibit and an enabling signal for bottle advance motor 47. When IC1-B is triggered, its output goes high, turning off transistors Q2 and Q5, and turning on transistors Q3 and Q4. This reverses the voltage applied to the motor 42 and drives manifold block 39 downwardly until down limit switch S2 is opened, stopping motor 42 and applying a positive voltage to the terminal of IC4 connected to the wash inhibit terminal in FIG. 4, thereby enabling the wash solution to be turned on during the time cycle provided by IC2-B.

IC2-A provides an approximate 15 second delay between the time the wash cycle is started and the time the wash water is turned on at valve 28. This provides a time for the manifold block 39 to be lowered to place wash and cleaning probes 22 and 23 inside sample container 17 in position 16 and for the old sample contained therein to be substantially removed. At the end of the fifteen second delay time, IC2-B is triggered if the wash inhibit signal to IC4 is high and wash water is admitted through valve 28 for a predetermined period of time. The wash solution delivery time is variable by adjusting resistor R9. This variable time is for the purpose of adjusting to allow for local variations in wash solution or water pressure. When IC2-B times out, the wash solution delivery is complete, IC3-A is triggered, turning on air inlet valve 66, which forces high pressure air through wash probe 22, purging residual washing solution contained therein. IC3-A also triggers IC3-B, which qualifies IC4 connected thereto, so that when the wash probe is withdrawn from sample container 17 and up limit switch S1 is opened, power is applied to bottle advance motor 47. The bottle advance motor 47 turns the supporting structure 46 (or 18 in FIG. 1) until the clean sample container 17 is advanced to the sampling position 14. A switch (not shown) senses the advance and resets all timers, turning off the compressor, opening valve 36 to allow chamber 33 to drain, and interrupting power to bottle advance motor 47. Latch IC4 is also reset and the sample inhibit signal is removed from sample cycle control 74.

The circuit of FIG. 4 contains circuit component IC6 connected to R13 and C20 for providing a 4 second power up time delay to prevent false triggering during power turn on. A manual bottle advance switch S3 is provided to trigger bottle drive timer IC3-B for driving the support structure 46 as described above. Timer IC3-B is reset by bottle position switch (not shown) when the next position is reached by support structure 46. Thus, the wash cycle controller contains a latching circuit IC4 to inhibit sample taking during a wash cycle, sequence control timing for control of wash solution introduction, positioning of manifold 39 between remote and wash and sample removal positions, sample container support drive and sample container support structure position.

A continuous sample receiving and storage apparatus has been disclosed which does not require surveillance. A series of most recent samples are collected which are free of contamination from previous samples stored in the sample containers and which dispenses the previous samples to waste when they become so old as to no longer be of interest.

What is claimed is:

1. A liquid sampler for obtaining predetermined number of samples from a flow to be sampled and for storing the samples for a predetermined period of time, comprising a sample container carrier, a plurality of sample containers supported on said sample container carrier in a predetermined array, said plurality of sample containers having access openings therein, means in communication with a liquid flow for withdrawing, measuring, and transferring liquid samples from the fluid flow to ones of said sample containers at a sampling position, a wash probe, an exhaust probe, said wash and exhaust probes being located in a cleaning position adjacent to said sampling position and further being configured to pass through said access openings, means for positioning each of said wash and exhaust probes in a lowered wash and exhaust position and a raised remote position, means coupled to said exhaust probe for withdrawing liquid sample and wash solution from ones of said sample containers, means coupled to said wash probe for conducting a wash solution to ones of said sample containers, means for driving said sample container carrier for positioning ones of said sample containers in said cleaning position and thereafter in said sampling position, means for controlling operating to actuate each of said means for positioning, means for withdrawing sample and wash solution, means for conducting wash solution, and means for driving during a cleaning cycle, whereby ones of said sample containers are exhausted and cleaned in said cleaning position and thereafter advanced to be filled with a liquid sample in said sampling position, and means for inhibiting said means in communication with a fluid flow, said means for inhibiting being controlled by said means for controlling and operating so that samples cannot be delivered to ones of said sample containers positioned in said sampling position during the exhausting and cleaning of ones of said sample containers in said cleaning position.

* * * * *